US009731921B2

(12) United States Patent
Howard et al.

(10) Patent No.: US 9,731,921 B2
(45) Date of Patent: Aug. 15, 2017

(54) WEB ROLL HANDLING AND LOADING SYSTEM

(71) Applicant: The Boeing Company, Chicago, IL (US)

(72) Inventors: Jesse P. Howard, Arlington, WA (US); Michael S. Lewis, Lake Forest Park, WA (US)

(73) Assignee: The Boeing Company, Chicago, IL (US)

( * ) Notice: Subject to any disclaimer, the term of this patent is extended or adjusted under 35 U.S.C. 154(b) by 51 days.

(21) Appl. No.: 14/321,991

(22) Filed: Jul. 2, 2014

(65) Prior Publication Data

US 2016/0001996 A1 Jan. 7, 2016

(51) Int. Cl.
*B65H 19/12* (2006.01)
*A47K 10/38* (2006.01)
*B65H 75/18* (2006.01)

(52) U.S. Cl.
CPC ..... *B65H 19/126* (2013.01); *A47K 10/38* (2013.01); *B65H 75/185* (2013.01); *B65H 2301/41346* (2013.01); *B65H 2301/41369* (2013.01); *B65H 2301/413665* (2013.01); *B65H 2801/03* (2013.01)

(58) Field of Classification Search
CPC ..... A47K 10/22; A47K 10/38; A47K 10/40; B65H 16/06; B65H 19/126; B65H 49/32; B65H 49/325; B65H 75/08; B65H 75/185; B65H 54/54; B65H 2301/41346
USPC .... 242/596, 596.1, 596.3, 596.7, 599, 599.4
See application file for complete search history.

(56) References Cited

U.S. PATENT DOCUMENTS 126,199 A * 4/1872 Gibbs ..... 112/254
509,691 A * 11/1893 Schlesinger ..... A47K 10/22 242/546.1
1,192,398 A * 7/1916 Dunlop ..... A47K 10/40 242/596.1
1,229,430 A * 6/1917 Farrell ..... A47K 10/22 242/596.3
1,702,971 A * 2/1929 Jeffress ..... B65H 16/06 242/537
1,742,029 A * 12/1929 Priester ..... B65H 16/06 242/559.4
1,778,282 A * 10/1930 Stewart ..... A47K 10/40 242/596.3

(Continued)

*Primary Examiner* — Emmanuel M Marcelo
*Assistant Examiner* — Michael Gallion
(74) *Attorney, Agent, or Firm* — Ostrager Chong Flaherty & Broitman PC

(57) ABSTRACT

A web roll handling and loading system and methods employ hubs positioned on opposing sides of a roll of web material wound on a hollow tubular core. Hub faces have an annular shape configured to be seated in respective ends of the hollow tubular core. The hubs are pivotably supported for pivoting between an operational position and a deflected position. The roll of web material is loaded on the hubs by lifting it from beneath the hubs to deflect the hub faces arcuately upward, then lowering the roll to allow the hub faces to pivot downward and become seated in the ends of the hollow tubular core. Alternatively, the roll is loaded into a pick-up tool by lowering the pick-up tool downward to the roll so the hubs deflect arcuately upward, then raising the tool so the hubs pivot downward and become seated in the hollow tubular core.

14 Claims, 17 Drawing Sheets

(56) References Cited

U.S. PATENT DOCUMENTS 1,897,266 A * 2/1933 McGeoch ..... A47K 10/22 242/596.1
1,913,363 A * 6/1933 Allen ..... A47K 10/22 242/596.4
1,999,759 A * 4/1935 Hope ..... A47K 10/22 242/596.3
2,101,531 A * 12/1937 Clemson ..... A47K 10/22 242/596.3
2,153,840 A * 4/1939 Margolith ..... A47K 5/05 248/309.2
2,371,109 A * 3/1945 Sanford ..... A47K 10/22 242/596.3
2,462,776 A * 2/1949 Price ..... A47K 10/22 225/33
2,467,825 A * 4/1949 Hall ..... A47K 10/22 242/596.1
2,514,778 A * 7/1950 Margo ..... A47K 10/40 211/85.12
2,546,820 A * 3/1951 Grant ..... A47K 10/22 242/599.1
2,555,885 A * 6/1951 Hope ..... A47K 10/40 242/596.4
2,566,883 A * 9/1951 Gove ..... A47K 10/22 242/596.3
2,643,069 A * 6/1953 Carlin ..... A47K 10/22 242/596.4
2,746,798 A * 5/1956 Wardell, Jr. ..... A47K 10/32 118/325
2,905,404 A * 9/1959 Simmons ..... A47K 10/40 242/423.2
2,991,953 A * 7/1961 Paterson ..... B65H 19/126 242/563.1
3,464,568 A * 9/1969 Hexter ..... A47K 10/04 211/105.6
3,847,365 A * 11/1974 Carol ..... A47K 10/38 242/596.4
3,847,709 A * 11/1974 Martin ..... B65H 16/02 156/510
3,944,094 A * 3/1976 Compton ..... B60P 3/035 254/2 R
4,002,238 A * 1/1977 Cameron ..... G11B 23/107 206/408
4,098,468 A * 7/1978 Skalleberg ..... B65H 54/54 242/470
4,121,783 A * 10/1978 Wolfinger ..... B65H 75/08 242/423.1
4,165,052 A * 8/1979 Seibert ..... B65H 54/54 242/470
4,209,140 A * 6/1980 Seibert ..... B65H 54/54 242/559
4,265,411 A * 5/1981 Fasolak ..... B65H 16/06 242/559.4
4,368,859 A * 1/1983 Focke ..... B65H 16/06 242/129.51
4,371,308 A * 2/1983 Skalleberg ..... B65H 54/54 414/416.01
4,447,012 A * 5/1984 Woodruff ..... B65H 16/06 242/423.1
4,452,403 A * 6/1984 Arronte ..... A47K 10/40 242/596.4
4,553,710 A * 11/1985 Pool ..... A47K 10/40 242/596.4
4,614,312 A * 9/1986 Del Pino ..... A47K 10/40 242/559
4,662,576 A * 5/1987 Paul ..... A47K 10/40 242/596.4
4,858,840 A * 8/1989 Kidman ..... A47K 10/38 242/596.3
4,893,763 A * 1/1990 Wales ..... B65H 16/06 242/420.3
5,028,097 A * 7/1991 Tucker ..... A47K 10/40 312/34.8
5,088,654 A * 2/1992 Cielker ..... B66F 3/24 242/591
5,242,127 A * 9/1993 Jaaskelainen ..... B65H 54/54 242/557
5,246,180 A * 9/1993 Berry, III ..... B65H 49/32 242/129.51
5,253,818 A * 10/1993 Craddock ..... A47K 10/40 242/596.4
5,332,166 A * 7/1994 Kepes ..... B65H 54/42 242/390.2
5,378,104 A * 1/1995 Payne, Jr. ..... B65H 19/126 242/592
5,597,133 A * 1/1997 Teague ..... A47K 10/38 221/102
5,782,428 A * 7/1998 Chabot ..... A47K 10/38 242/596.3
5,806,787 A * 9/1998 Schneider ..... B65H 49/325 242/129.5
5,897,073 A * 4/1999 McVaugh ..... B60P 3/035 242/390.5
6,092,758 A * 7/2000 Gemmell ..... A47K 10/40 242/596.4
6,189,828 B1 * 2/2001 Reilly ..... A47K 10/40 242/596.4
6,328,253 B1 * 12/2001 Paul ..... A47K 10/40 242/596.3
6,347,761 B1 * 2/2002 Larson ..... B65H 49/32 242/390.5
6,386,478 B2 * 5/2002 Reilly ..... A47K 10/40 242/596.4
6,786,377 B1 * 9/2004 Holden ..... A47K 10/38 206/409
6,837,455 B2 * 1/2005 Eckhard ..... A47K 10/40 242/596.4
7,000,900 B1 * 2/2006 McKenney ..... B65H 49/32 254/124
7,077,368 B1 * 7/2006 Karoly ..... B65H 49/32 242/598.3
7,360,740 B2 * 4/2008 Reagan ..... B60P 1/003 242/596.1
7,513,453 B2 * 4/2009 Cattacin ..... A47K 10/38 242/596.7
7,918,262 B2 * 4/2011 Chiu ..... B65H 35/0026 156/510
9,079,745 B2 * 7/2015 Galindo Gonzalez . B65H 49/32
9,290,357 B2 * 3/2016 Mays ..... B65H 75/425
2003/0221914 A1 * 12/2003 Smith ..... H05K 7/1488 187/244
2003/0230666 A1 * 12/2003 Chlipalski ..... A47K 10/40 242/596.4
2006/0157612 A1 * 7/2006 Benz ..... B65H 19/126 242/599
2009/0196723 A1 * 8/2009 Smith ..... B60P 3/035 414/546
2011/0041461 A1 * 2/2011 Nelson ..... B65B 41/12 53/450
2011/0215187 A1 * 9/2011 Owurowa ..... A47K 10/38 242/550
2012/0097789 A1 * 4/2012 Benedetti ..... B65H 75/245 242/598.3
2012/0104016 A1 * 5/2012 Benedetti ..... A47K 10/38 221/92
2013/0047554 A1 * 2/2013 Bertram ..... B65H 23/182 53/452
2015/0216375 A1 * 8/2015 Okazaki ..... A47K 10/38 242/596.4
2015/0374182 A1 * 12/2015 Delaney ..... A47K 10/421 221/1

* cited by examiner

WEB ROLL HANDLING AND LOADING SYSTEM

TECHNICAL FIELD

This disclosure generally relates to a handling and loading system for a roll of web material. In particular, it is directed to a system and method for easy loading of a roll of web material onto axial hubs, handling the roll of web material, and easy un-loading of the roll of web material from the axial hubs.

BACKGROUND

Rolls of web material are used in a wide variety of personal, commercial and industrial applications where a web of material is to be supplied from the roll. A conventional arrangement, such as is commonly used for roll-feeding in the paper printing industry, consists of a roll of web material wound on an axle or on a hollow tube adapted with a mandrel through the tube. Due to the weight and size of the roll of web material, the roll of web material is typically lifted by a lift mechanism and placed in position with ends of the axle or the mandrel seated in opposing saddles or bearing holders. A web driving or pulling mechanism can then engage the roll of web material and feed the web material into an associated production process.

In most applications, precise care is required for placement of an axle or mandrel into the hollow tubular core of the roll of web material and lifting the roll of web material onto supporting saddles or bearing holders. Mandrels are typically quite heavy, roughly 30 to 50 pounds, can be difficult to install, and are prone to breaking during installation or use. Restricted access to the mounting position for the roll of web material also often limits utilization of conventional lifting devices such as cranes or forklifts, and therefore requires difficult manual lifting and placement, causing delay and reducing overall efficiency.

SUMMARY

The foregoing problems with prior art roll-feeding devices are overcome by providing a system for handling and loading a roll of web material wound on a hollow tubular core onto a pair of pivotably mounted hubs, and un-loading the roll of web material from the pair of pivotably mounted hubs. The system obviates the need for an axle or mandrel to be placed in the hollow tubular core to support and handle the roll of web material.

The roll handling and loading system for a roll of web material comprises a pair of hubs positioned on opposing sides of a horizontally-oriented space in which the roll of web material is positioned. Each of the hubs comprises a hub face having an annular shape, and each of the hubs are pivotably supported on a pivot mechanism for pivoting movement between an operational position on a horizontal rotational axis and a deflected position in which the hub face of each of the hubs is deflected in an arcuate direction away from the horizontal rotational axis. The pivot mechanism is adapted to deflect each of the hubs to a deflected position above the horizontal rotational axis.

In one embodiment of the system, the pair of hubs is transitioned from the operational position to the deflected position by the roll of web material when the roll of web material is lifted from beneath the horizontal rotational axis of the pair of hubs. Subsequent lowering of the roll of web material allows the pair of hubs to transition from the deflected position to the operational position and become seated in respective ends of the hollow tubular core of the roll of web material so as to bear the weight of the roll of web material. Release of the roll of web material from the hubs only requires the roll to be lifted upwardly and beyond the reach of the pivoting hubs.

In another embodiment, a pick-up tool comprises a pair of hubs that is movable in a vertical direction. The pair of hubs is transitioned from the operational position to the deflected position by the roll of web material when the pair of hubs is lowered from a position above the roll of web material to a position where the hubs engage respective ends of the roll of web material in the horizontally-oriented space, and subsequent raising of the pair of hubs allows the pair of hubs to transition from the deflected position to the operational position and become seated in respective ends of the hollow tubular core of the roll of web material. The pick-up tool may be used to pick up the roll of web material and transport it to another location. Release of the pick-up tool from the roll of web material only requires the hubs be lowered, to cause the hubs to pivot upward and disengage from the ends of the hollow tubular core, beyond the reach of the pivoting hubs.

In both embodiments, the hubs tilt up and away from the ends of the roll of web material and then drop into position within the ends of the hollow tubular core when the hub faces become engaged therewith. The subsequent lowering of the roll of web material or the subsequent raising of the hubs with respect to the roll of web material allows the hubs to pivot back down into the ends of the hollow tubular core to become fully seated therein in the operational position.

A preferred embodiment of the system may be configured so that the hubs have hub faces with a beveled configuration for positive seating in the ends of the hollow tubular core of the roll. One of the hubs in the pair of hubs may be biased along the horizontal rotational axis of the roll of web material toward the other hub to accommodate variations in a horizontally-oriented length of the roll of web material.

Related methods of making and using the roll handling and loading system are also considered to be within the scope of the present disclosure. Other objects, features, and advantages of the various embodiments in the present disclosure will be explained in the following detailed description with reference to the appended drawings.

DETAILED DESCRIPTION

In the following detailed description, certain preferred embodiments are described to illustrate the general principles in the present disclosure. It will be recognized by one skilled in the art that the present disclosure may be practiced in other analogous applications or environments and/or with other analogous or equivalent variations of the illustrative embodiments. For example, several pivot mechanisms are described for pivoting hubs in the roll handling and loading system, but any type of pivot mechanism may be employed in the system to provide the desired functionality. In addition, the disclosed system may be used for handling and loading any type of web material that is rolled on a hollow inner core that can support the weight of the rolled web material. It should also be noted that those methods, procedures, components, or functions which are commonly known to persons of ordinary skill in the field of the invention are not described in detail herein so as avoid unnecessarily obscuring a concise description of the preferred embodiments.

Figure 1:
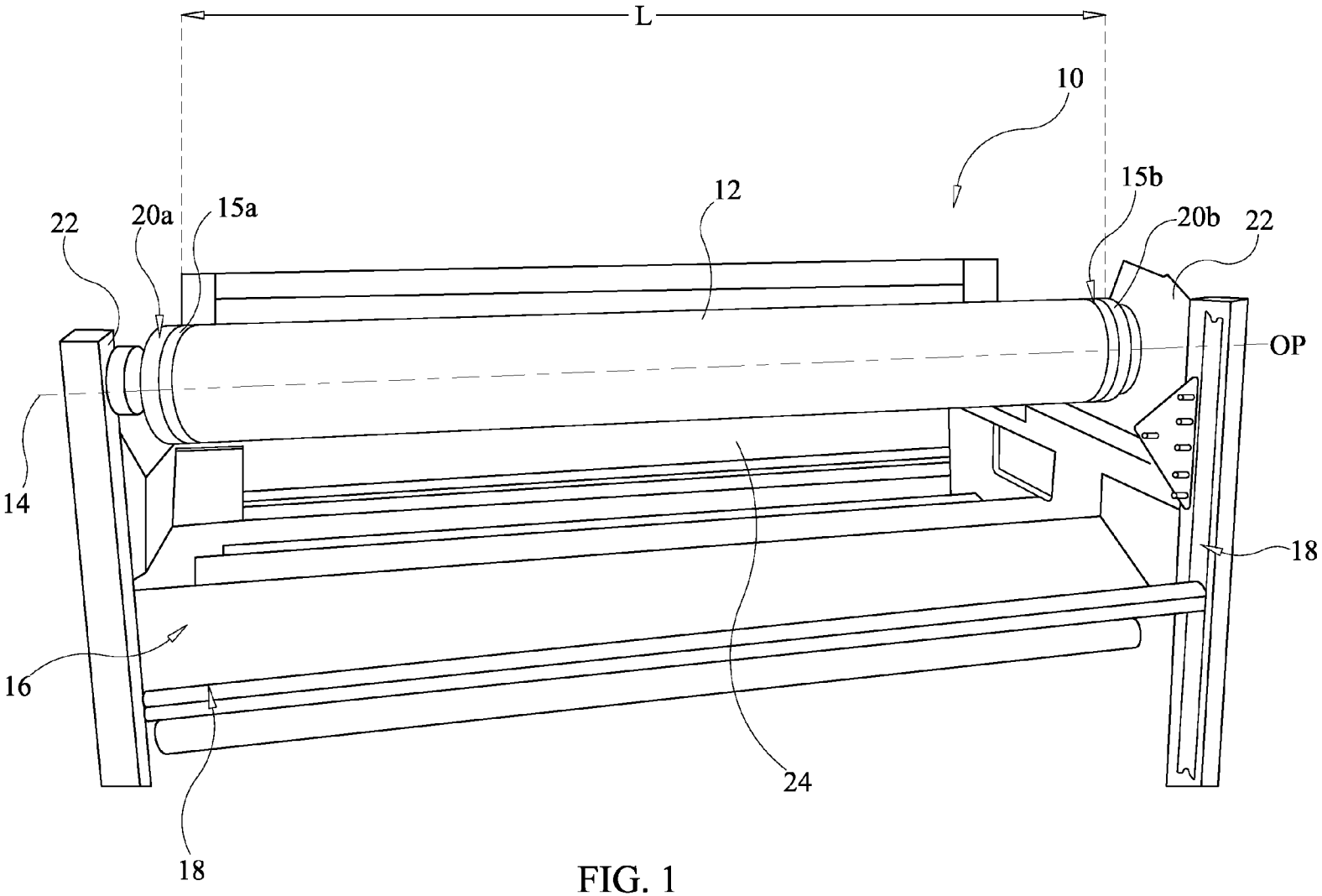
FIG. 1 illustrates an exemplary roll-feeding environment of use in which the roll handling and loading system may be used.

FIG. 1 shows an exemplary environment of use 10 for roll-feeding a roll 12 of web material 13. A web material 13 is wound on a hollow tubular core 15 (not shown within the roll 12 of web material 13 in FIG. 1; see FIG. 2) to form a roll 12 of web material 13. The roll 12 of web material 13 has a horizontally-oriented length L between respective ends 15*a*, 15*b* of the hollow tubular core 15, and is mounted in an operational position OP along a horizontal rotational axis 14 for roll-feeding. The roll 12 of web material 13 is placed (such as by forklift, manually or other lifting means) on a hopper 16 and is lifted to the operational position OP by a lift mechanism 18. Alternatively, a forklift or other lifting means (not shown) may be used to directly place the roll 12 of web material 13 in the operational position OP without using a hopper 16 or other type of built-in lift mechanism 18.

The disclosed system obviates the need for an axle, mandrel or any other device to be sleeved within the hollow tubular core 15 to support the roll 12 of web material 13, as is required by conventional roll-feeding systems. Instead, the disclosed roll handling and loading system comprises a pair of hubs 20*a*, 20*b* positioned on opposing sides 22 of a horizontally-oriented space 24 in which the roll 12 of web material 13 is positioned. The hubs 20*a*, 20*b* are seated in respective ends 15*a*, 15*b* of the hollow tubular core 15 so as to bear the weight of the roll 12 of web material 13.

Figure 2:
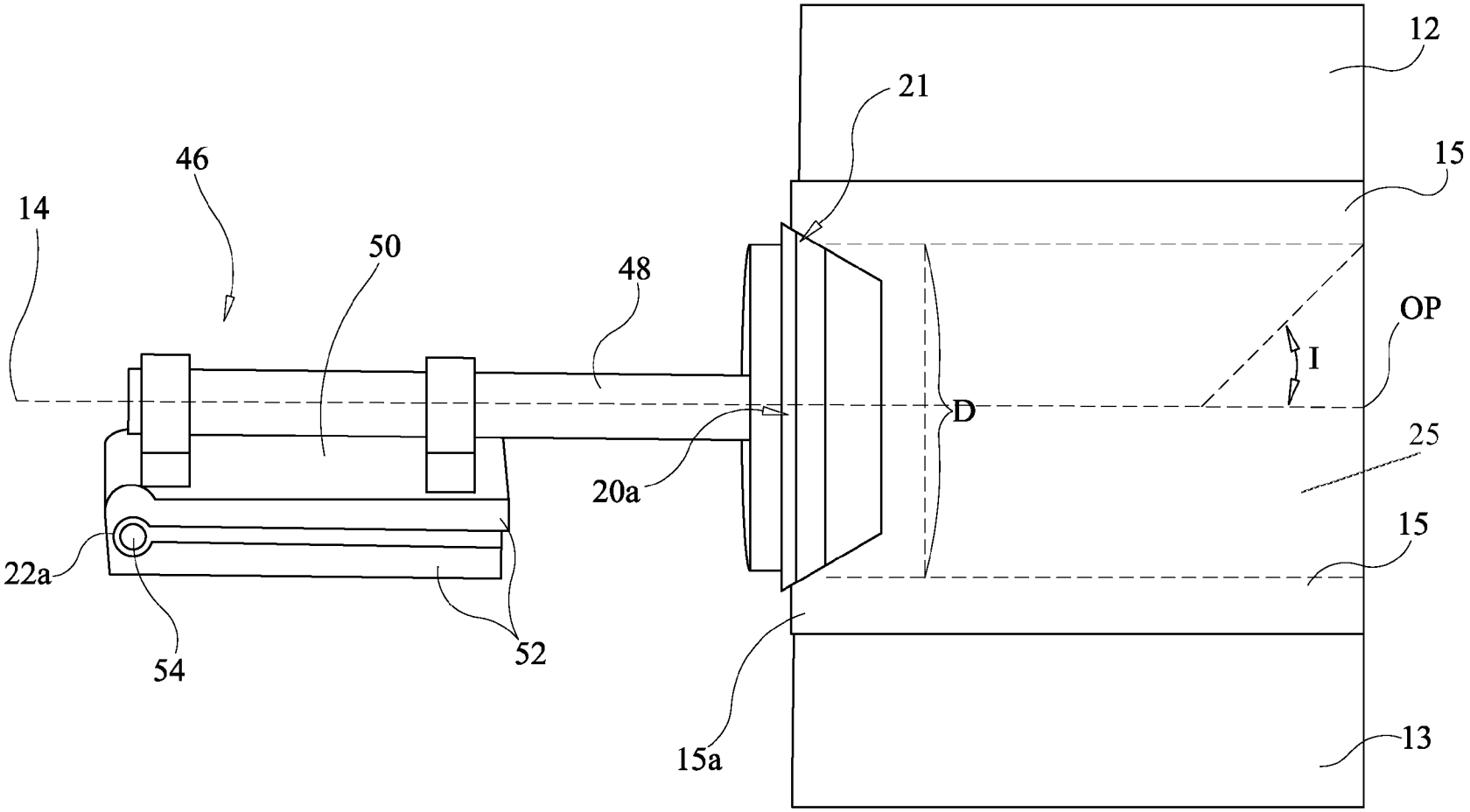
FIG. 2 illustrates a cross-sectional schematic view of one embodiment of a pivotably supported hub on one side of the roll handling and loading system (the other side being a mirror image thereof).
Figure 3A:
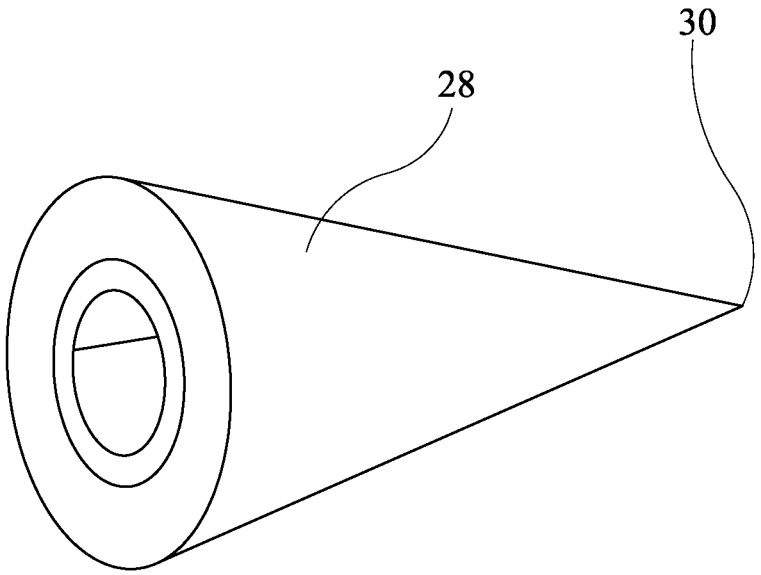
FIGS. 3A-3D illustrate alternative hub face configurations for use in the roll handling and loading system.
Figure 3B:
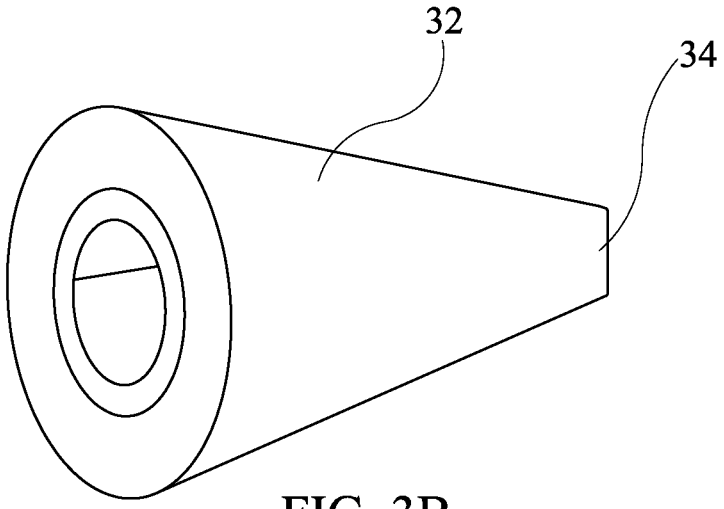
Figure 3C:
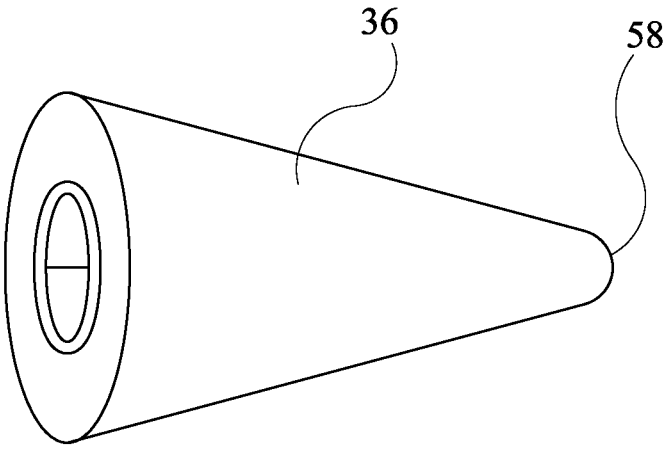
Figure 3D:
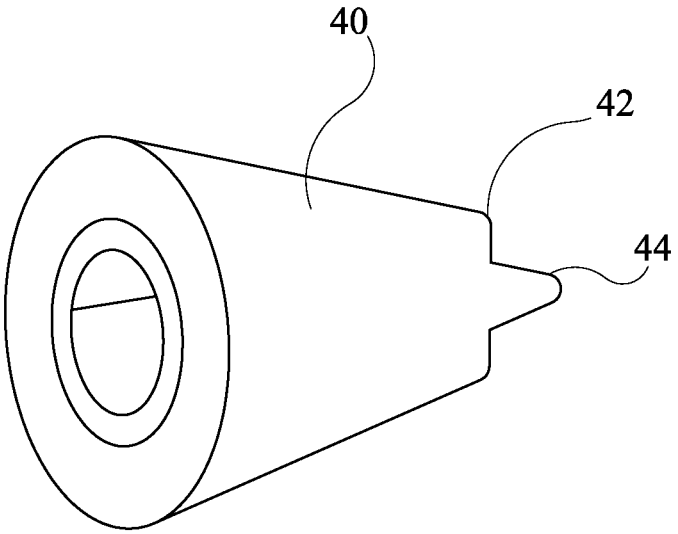

In FIG. 2, a cross-sectional schematic view of a hub 20*a* on a left side of the system (the right side being a mirror image thereof) is illustrated. Each of the hubs 20*a*, 20*b* has a hub face 21 engaged in respective ends 15*a*, 15*b* of the hollow tubular core 15 on which the web material 13 is wound. The hub face 21 preferably has an annular, and more preferably a cone or beveled, cross-sectional shape for positive seating in the respective ends 15*a*, 15*b* of the hollow tubular core 15. The cone or beveled shape may be configured with an incline of any angle I that permits the hub face 21 to enter and exit the hollow tubular core 15 as described herein. For example, an incline angle I of about 45 degrees with respect to the horizontal rotational axis 14 permits the hubs 20*a*, 20*b* to tilt up and away from respective ends 15*a*, 15*b* of the roll 12 and then drop into position within the hollow space 25 defined by the hollow tubular core 15 when the hub faces 21 become engaged with the respective ends 15*a*, 15*b* of the hollow tubular core 15. In general, the incline angle I of the hub face 21 depends upon such factors as the diameter and depth of the hub face 21, and the inner diameter D of the hollow tubular core 15. Examples of cross-sectional annular shapes for the hub face 21 are shown in FIGS. 3A-3D. FIG. 3A shows a cone shaped smooth surface 28 extending to a distal point 30. FIG. 3B shows a cone shaped smooth surface 32 extending to a flattened distal end 34. FIG. 3C shows a cone shaped smooth surface 36 extending to a rounded distal end 38. FIG. 3D shows a cone shaped beveled surface 40 with a bevel 42 extending to a flattened distal end 44.

Each of the hubs 20*a*, 20*b* is pivotably supported on a pivot mechanism 46 for pivoting movement between a load-bearing operational position OP on the horizontal rotational axis 14 (shown in FIG. 2) and a deflected position DP in which the hub face 21 of each of the hubs 20*a*, 20*b* is deflected in an arcuate direction away from the horizontal rotational axis 14. The deflected position DP is shown in FIG. 5B as an upwardly-pivoted raised position, but the pivot mechanism may also be configured to pivot downward to a downwardly-pivoted deflected position.

Figure 4A:
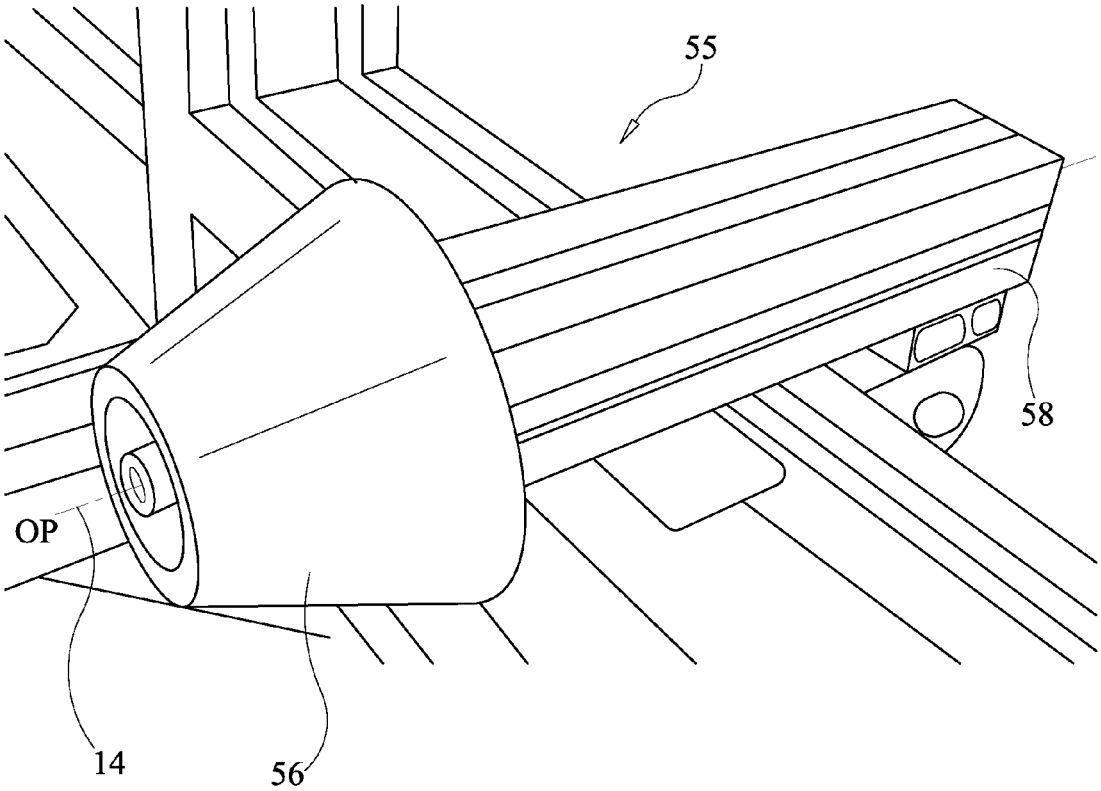
FIGS. 4A-4C illustrate alternative pivot mechanism configurations for use in the roll handling and loading system.
Figure 4B:
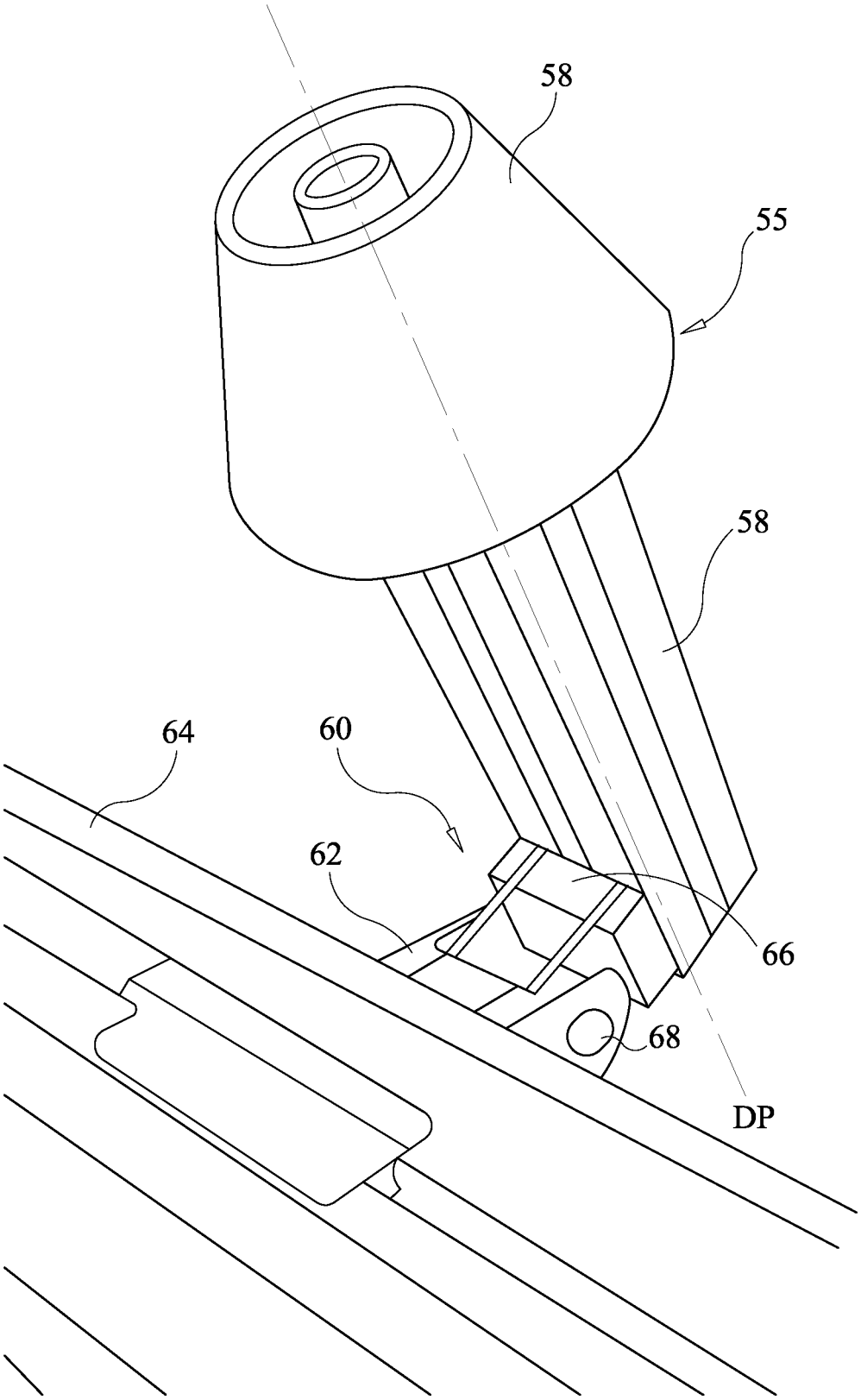
Figure 4C:
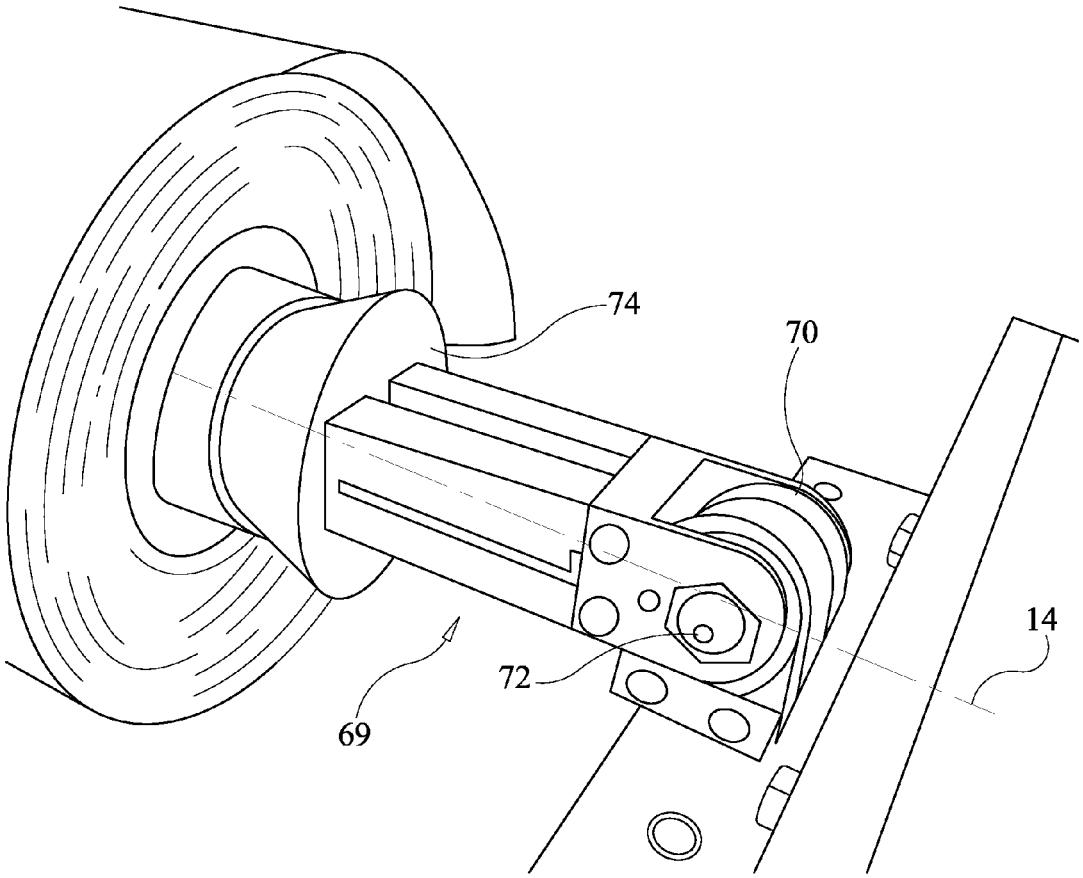

Any type of pivot mechanism 46 may be used to provide pivoting movement to the hubs 20*a*, 20*b*. One example of a suitable pivot mechanism 46 is shown in FIGS. 2, 5A-5E and 6A-6C. Referring to FIG. 2, the hub 20*a* is supported on a shaft 48 mounted to a hinged platform 50 having block faces 52 pivotable with respect to each other on a hinge axis 54 (or other pivot or rotational mechanism) to thereby allow hub 20*a* to be pivoted between the operational position OP and the deflected position DP. Any type of coupling arrangement may be used to couple the hubs 20*a*, 20*b* and the shaft 48 to the hinged platform 50 or other pivot mechanism 46 that permits pivoting to occur freely. For example, alternative pivot mechanisms are shown in FIGS. 4A-4C. FIG. 4A and FIG. 4B show an alternative pivot mechanism 55 comprising a pivoting hub 56 supported on a shaft 58 in a load-bearing operative position OP and deflected position DP, respectively. A hinge 60 in the alternative pivot mechanism 55 comprises a first hinge part 62 attached to a frame 64 of the roll handling and loading system and a second hinge part 66 attached to the shaft 58. The first hinge part 62 and the second hinge part 66 are pivotably coupled together at a pivot point 68. It is preferable that the pivot point 68 is positioned on or below the horizontal rotational axis 14 of the pivoting hub 56 in the load-bearing operative position OP. FIGS. 4A and 4B show the alternative pivot mechanism 55 with a pivot point 68 positioned below the horizontal rotational axis 14. FIG. 4C shows another embodiment of a pivot mechanism 69 with a pivotable hinge 70 forming a pivot point 72 on the horizontal rotational axis 14 of the hub 74.

FIGS. 5A-5E are a sequence of schematic views illustrating the functionality of the pivot mechanisms and the method steps for loading a roll 12 of web material 13 onto the pair of hubs 20*a*, 20*b* (only one hub 20*a* and the left side of the roll 12 of web material 13 are shown; the other hub 20*b* and right side of the roll 12 of web material 13 are mirror images and work the same way). The method steps are also set forth in FIG. 7A. In general, to load the roll 12 of web material 13 onto the hubs 20*a*, 20*b*, the roll 12 of web material 13 is used to move the hubs 20*a*, 20*b* such that the distance between the hubs 20*a*, 20*b* (i.e., the horizontally-oriented space 24) is greater than the horizontally-oriented length L of the roll 12 of web material 13 when in the deflected position DP and less than the horizontally-oriented length L of the roll 12 of web material 13 when in the load-bearing operation position OP while maintaining the hinge axis 54, or pivot points 68, 72, in a stationary position on or below the horizontal rotational axis 14 of the hubs 20*a*, 20*b* when in the load-bearing operational position OP.

Figure 5A:
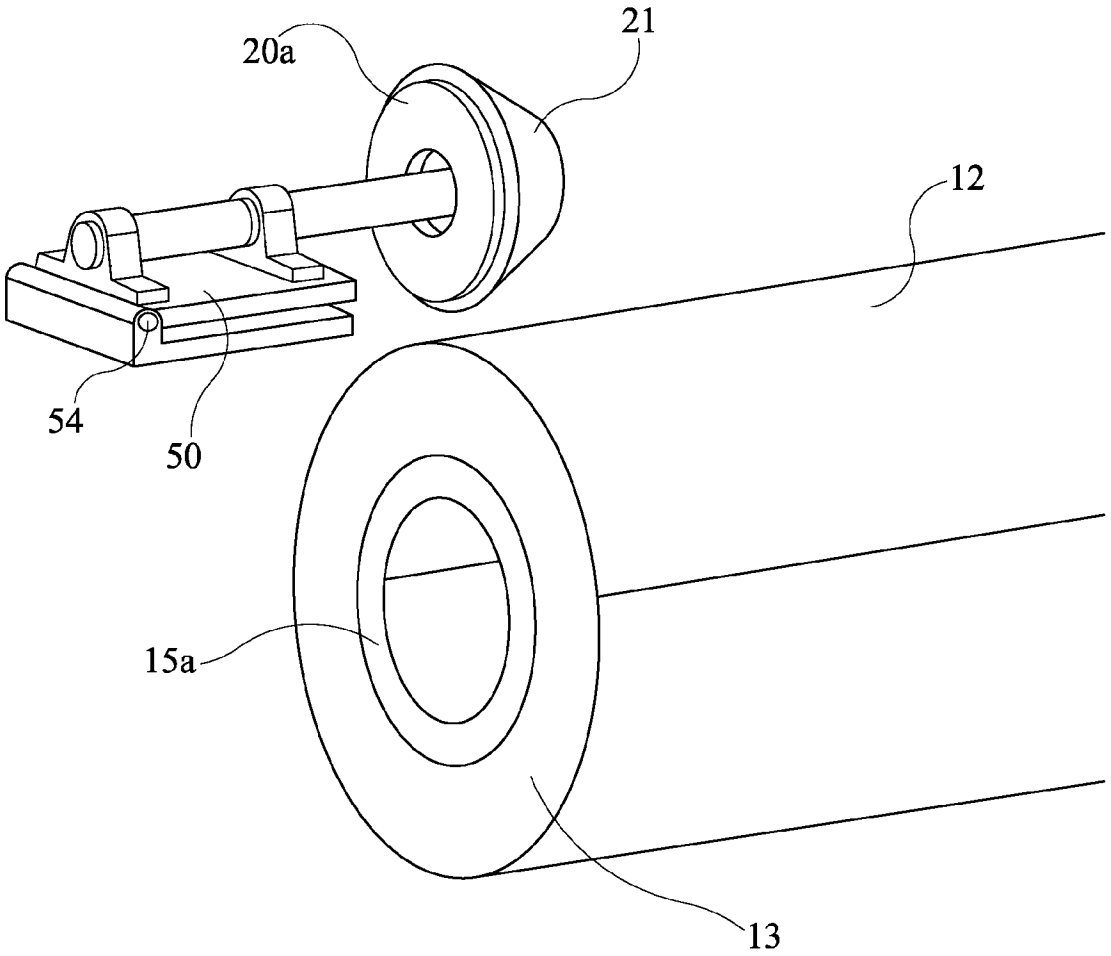
FIGS. 5A-5E are a sequence of schematic views illustrating loading of a roll of web material on pivotably supported hubs in the roll handling and loading system.
Figure 5B:
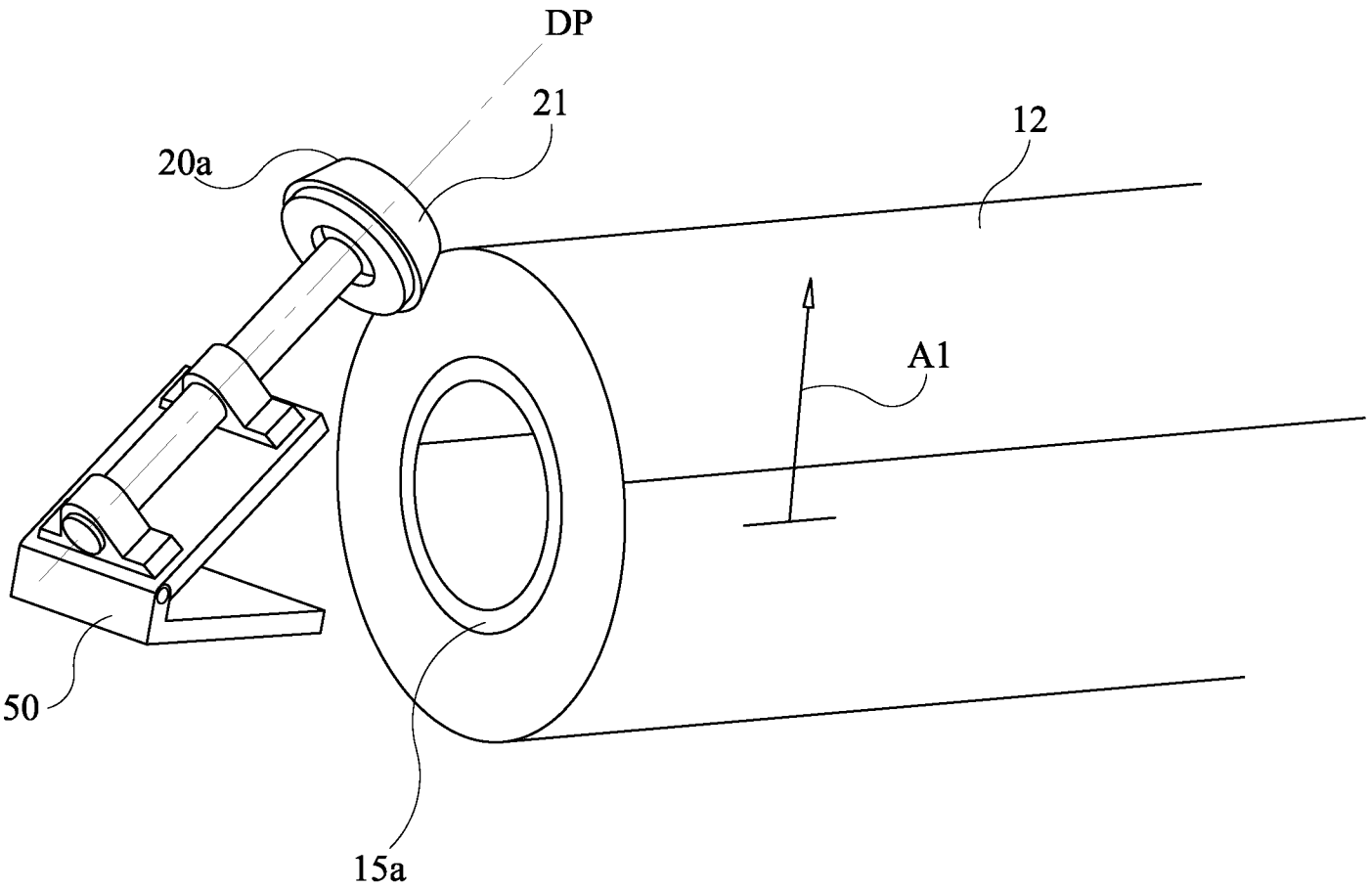
Figure 7A:
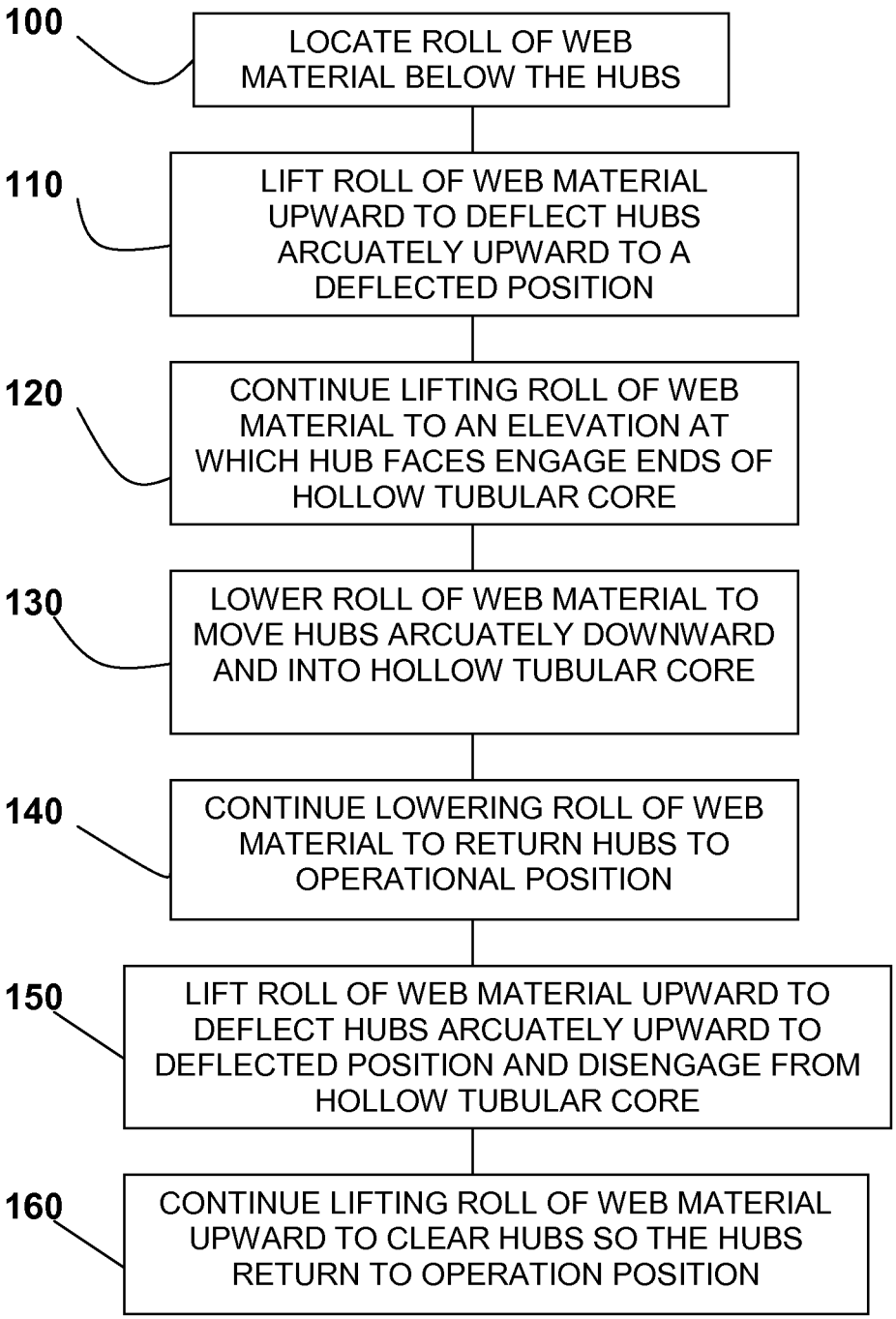
FIGS. 7A-7B are block diagrams illustrating methods of using the roll handling and loading system.

Referring to FIG. 7A and FIG. 5A, a first step 100 of the method is to locate the roll 12 of web material 13 below the hubs 20*a*, 20*b* in a position ready for loading onto the hubs 20*a*, 20*b*.

In FIG. 5B, a second step 110 of the method is to lift roll 12 of web material 13 upward in the direction of arrow A1 so that the hub 20*a* has its hub face 21 deflected arcuately upward to the deflected position DP by the roll 12 of web material 13 when the roll 12 of web material 13 is lifted.

Figure 5C:
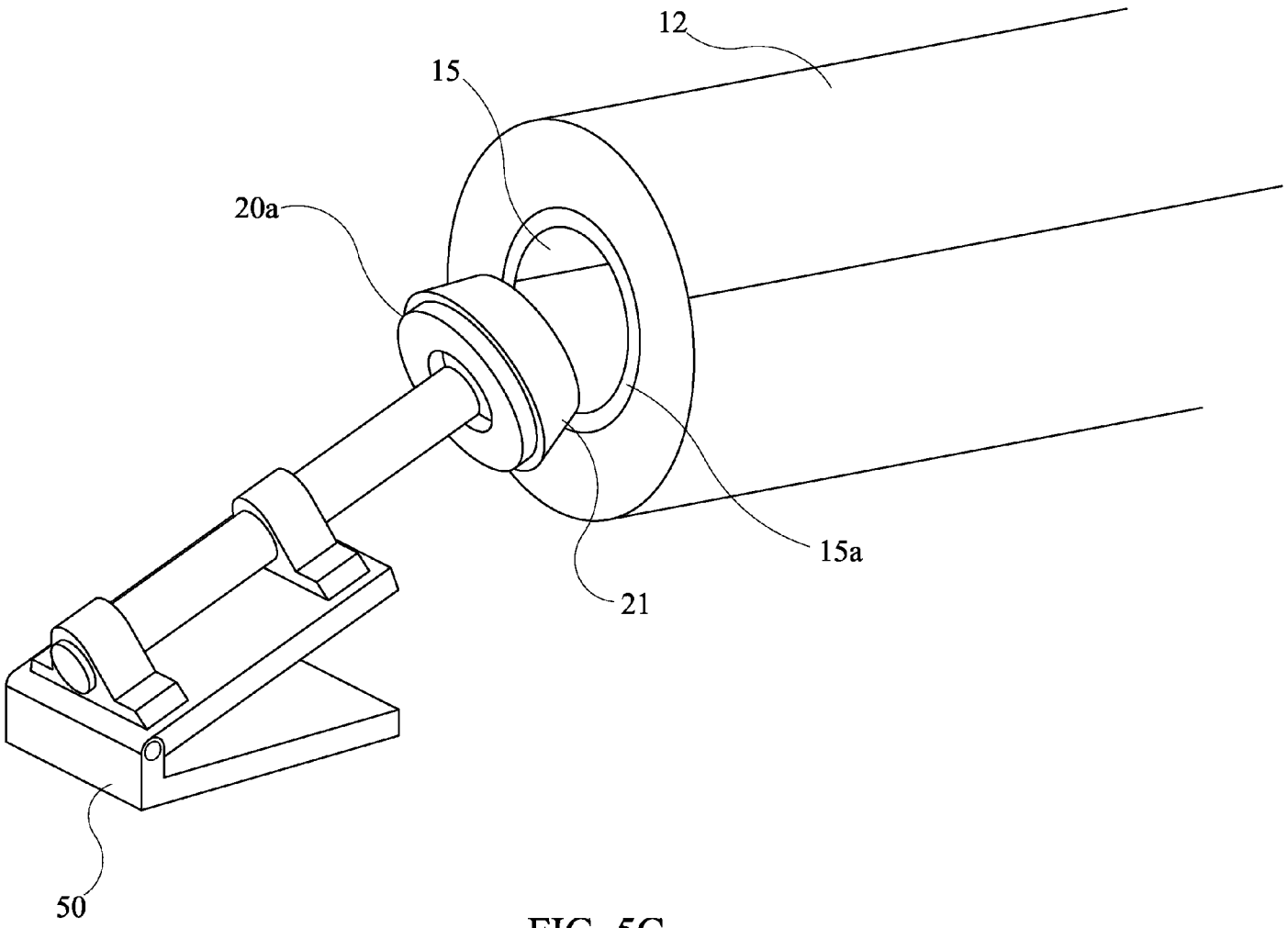

In FIG. 5C, a third step 120 of the method is to further lift the roll 12 of web material 13 to an elevation at which the hub face 21 can engage into the end 15*a* of the hollow tubular core 15. That is, the hub face 21 drops into the hollow space 25 defined by the hollow tubular core 15.

Figure 5D:
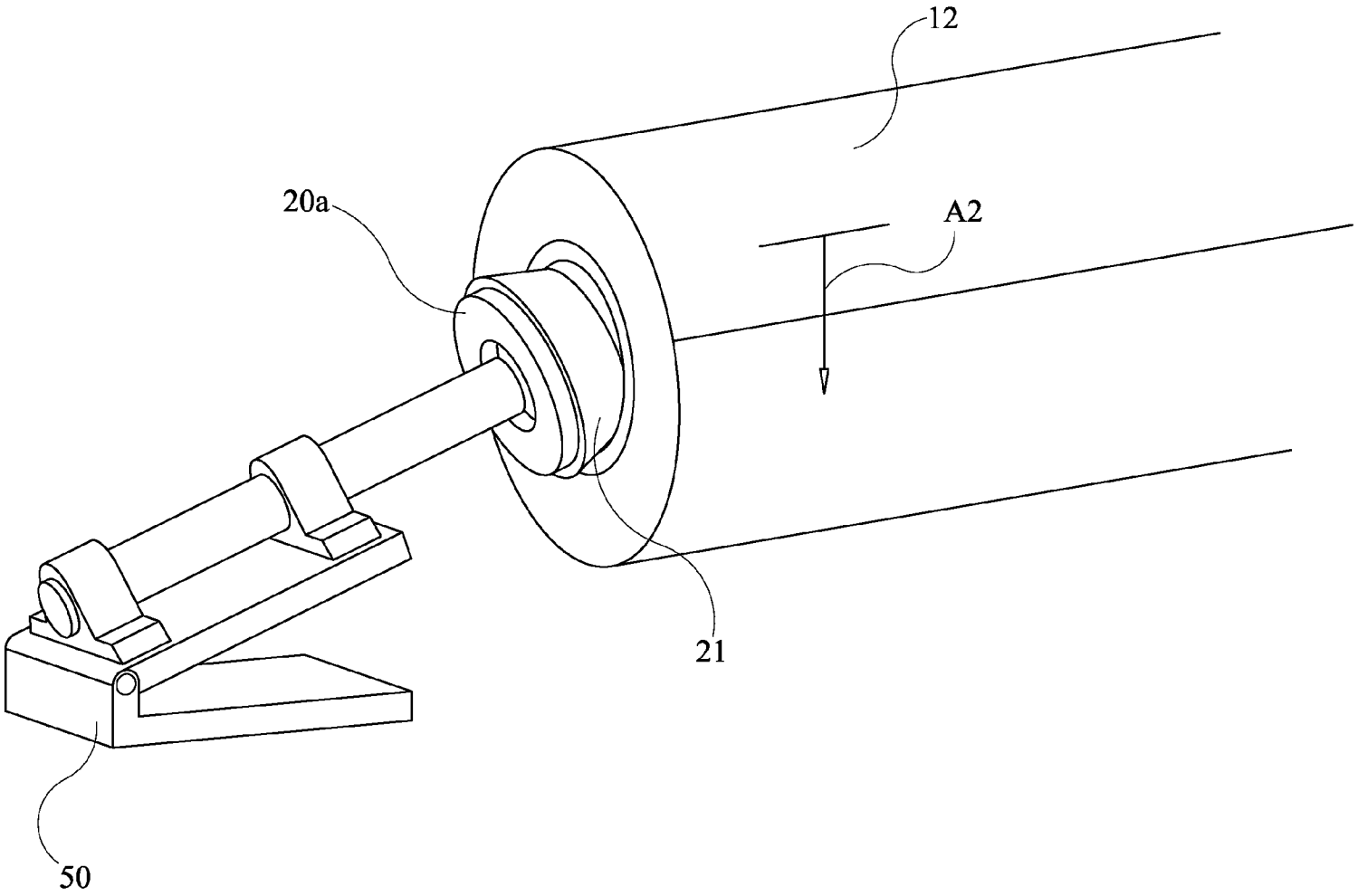

In FIG. 5D, a fourth step 130 of the method is to lower the roll 12 of web material 13 in the direction of arrow A2 to permit the hub 20*a* to move in an arcuately downward direction so that the hub face 21 can fully engage into the end 15*a* of the hollow tubular core 15.

Figure 5E:
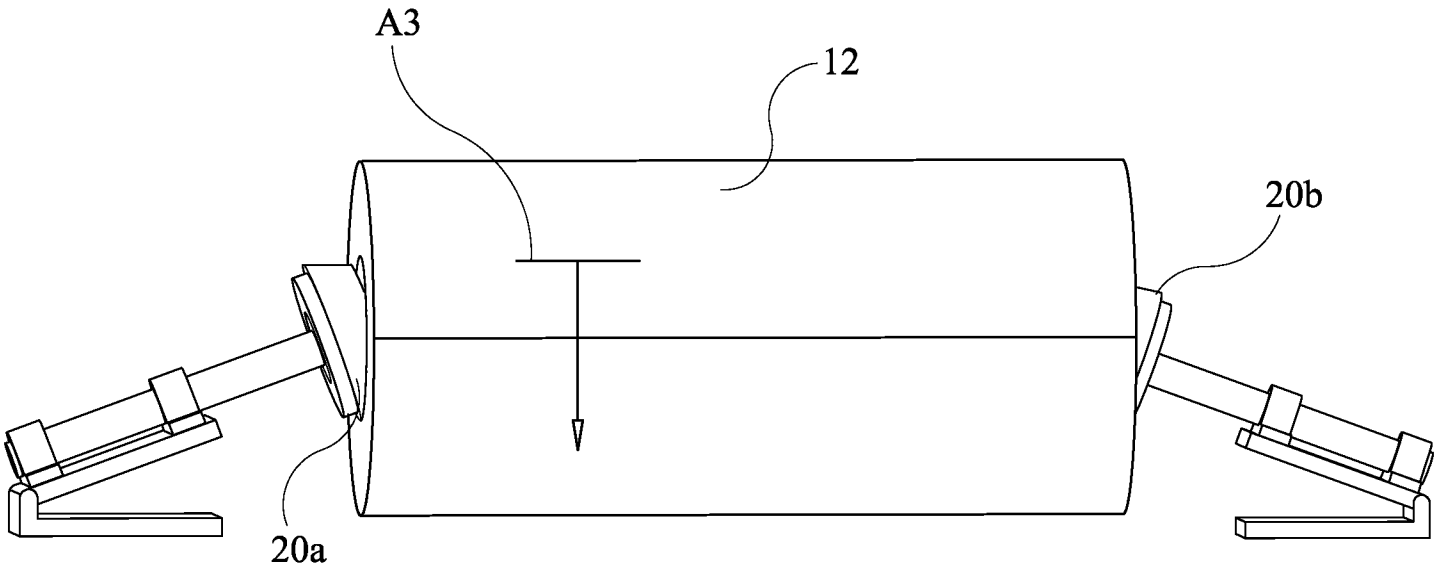

In FIG. 5E, a fifth step 140 of the method is to continue lowering the roll 12 of web material 13 in the direction of the arrow A3 until the hubs 20*a*, 20*b* return to the operational position OP, where the hubs 20*a*, 20*b* are securely seated in respective ends 15*a*, 15*b* of the hollow tubular core 15.

As set forth above, the pair of hubs 20*a*, 20*b* is transitioned from the operational position OP to the deflected position DP by the roll 12 of web material 13 when the roll 12 of web material 13 is lifted from beneath the horizontal rotational axis 14 of the hubs 20*a*, 20*b* into the horizontally-oriented space 24, and subsequent lowering of the roll 12 of web 13 material allows the hubs 20*a*, 20*b* to transition from the deflected position DP to the operational position OP and become seated in respective ends 15*a*, 15*b* of the hollow tubular core 15 of the roll 12 of web material 13 so as to bear the weight of the roll 12 of web material 13.

Figure 6A:
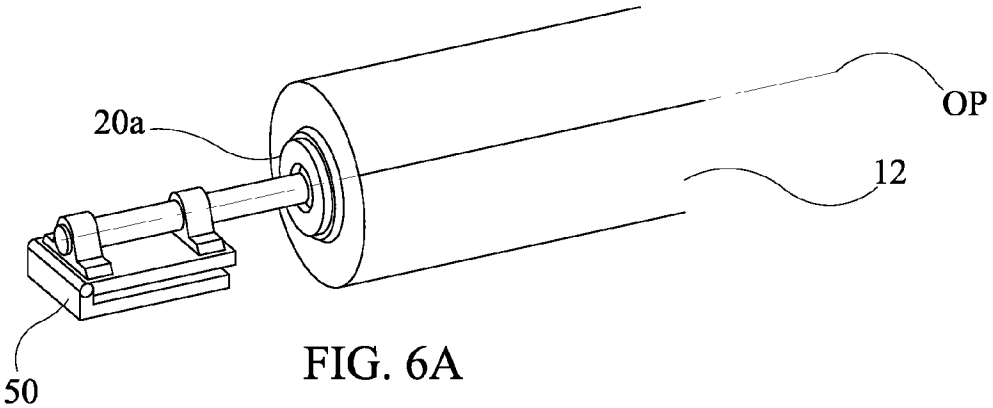
FIGS. 6A-6C are a sequence of schematic views illustrating unloading of a roll of web material from pivotably supported hubs in the roll handling and loading system.
Figure 6B:
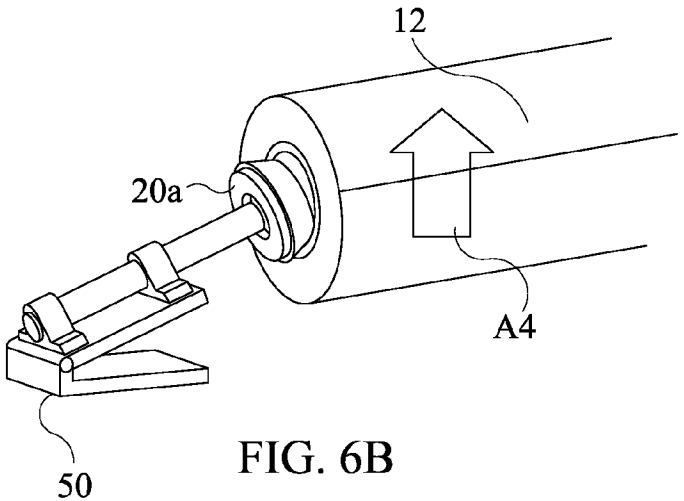
Figure 6C:
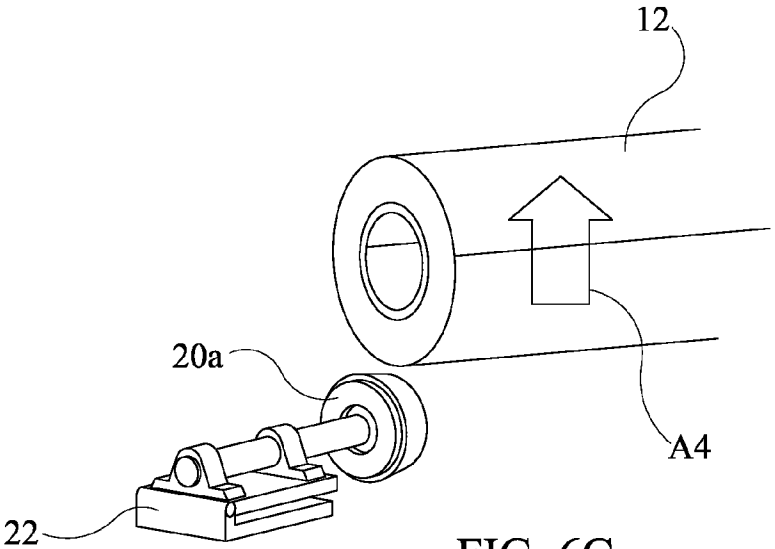

FIGS. 6A-6C are a sequence of schematic views illustrating the functionality of the pivot mechanisms and the method steps for unloading of a roll 12 of web material 13 from the pair of hubs 20*a*, 20*b* (only one hub 20*a* and the left side of the roll 12 of web material 13 are shown; the other hub 20*b* and right side of the roll 12 of web material 13 are mirror images and work the same way). Referring to FIG. 7A and FIG. 6A, the roll 12 of web material 13 is shown in the operational position OP. The hubs 20*a*, 20*b* are seated in the respective ends 15*a*, 15*b* of the hollow tubular core 15. In FIG. 6B, the method step 150 comprises lifting the roll 12 of web material 13 upward in the direction of arrow A4 to cause the hubs 20*a*, 20*b* to deflect arcuately upward to the deflected position DP so that the hub face 21 begins to disengage from the hollow tubular core 15. In FIG. 6C, the method step 160 comprises continuing to lift the roll 12 of web material 13 upward in the direction of arrow A4 to an elevation such that the roll 12 of web material 13 is no longer in contact with the hubs 20*a*, 20*b*, so that the hubs 20 are returned to the operational position OP, preferably by force of gravity as a result of the freely-pivoting pivot mechanism 46.

The pivot mechanism 46 supporting the hubs 20*a*, 20*b* may be provided with a damper mechanism to enable controlled deflection from the operational position OP to the deflected position DP and retraction from the deflected position DP to the operational position OP. A brake or clutch may also be provided to the hubs 20*a*, 20*b* to apply or release tension on the roll during roll-feeding.

Figure 8:
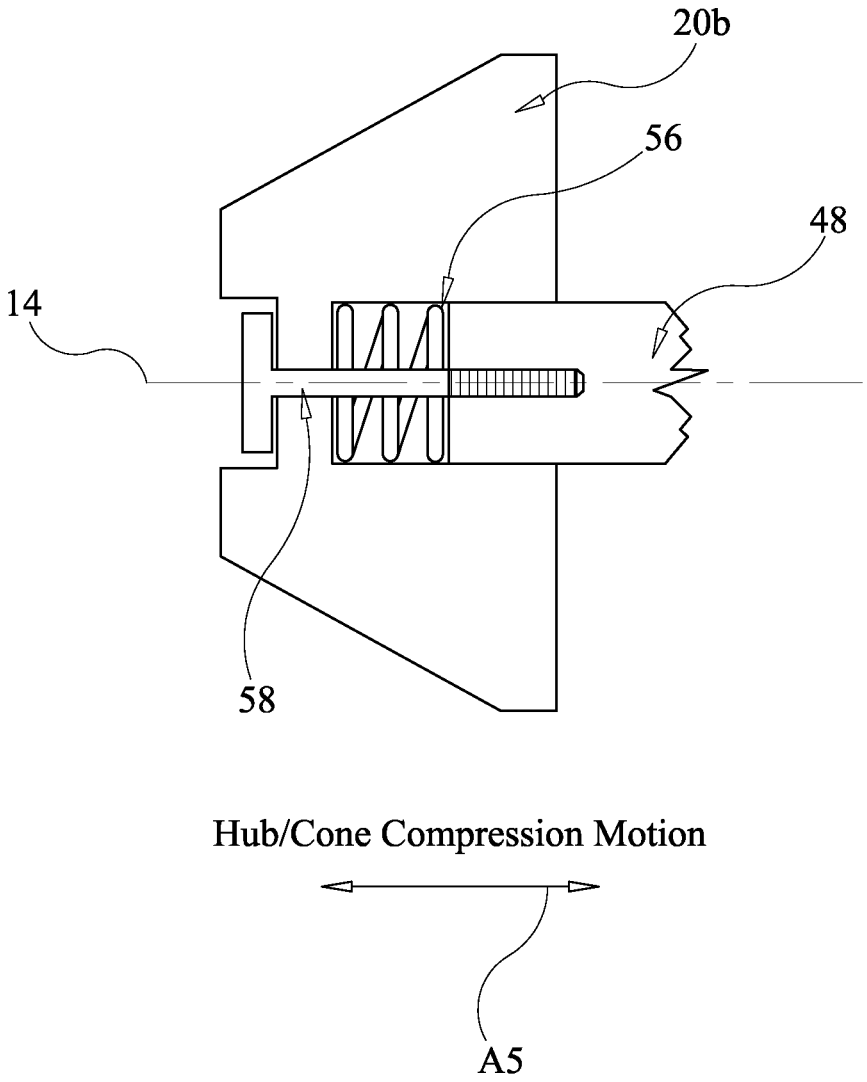
FIG. 8 illustrates a cross-sectional schematic view of one embodiment of a hub having a compression spring for use in the roll handling and loading system.

One of the hubs 20*a*, 20*b* may be biased along the horizontal rotational axis 14 toward the other of the hubs 20*a*, 20*b* to accommodate variations in the horizontally-oriented length L of the roll 12 of web material 13 and/or to provide tension along the horizontal rotational axis 14 to ensure that the hubs 20*a*, 20*b* are securely seated in the hollow tubular core 15. For example, referring to FIG. 8, a hub 20*b* may be configured with a compression spring 76 positioned along the horizontal rotational axis 14, such that when the hub 20*b* is seated in the hollow tubular core 15 and the roll 12 of web material 13 is lowered, the compression spring 76 compresses to provide inward force toward the roll 12 of web material 13 in the direction of arrow A5 and a secure fit between the hub 20*b* and the hollow tubular core 15. A stripper bolt 78 is provided to adjust the compressive force of the compression spring 76. In other embodiments, one or both of the hubs 20*a*, 20*b* may be configured to be adjustable in a horizontal direction, along the horizontal rotational axis 14, such as with rack-and-pinion parts.

The hubs 20*a*, 20*b* may be made from any material suitable for supporting the weight of a roll 12 of web material 13. The hubs 20*a*, 20*b* may be adapted to spin and engage the roll 12, such as by including a bearing within the hubs 20*a*, 20*b*. Or, the hubs 20*a*, 20*b* may be stationary (without a bearing) and the surfaces of the hub faces 21 may be treated with a non-stick material to permit the roll 12 to rotate on the hub faces 21, such as TEFLON®, a registered trademark of E.I. DuPont De Nemours and Company of Wilmington, Del.

Figure 7B:
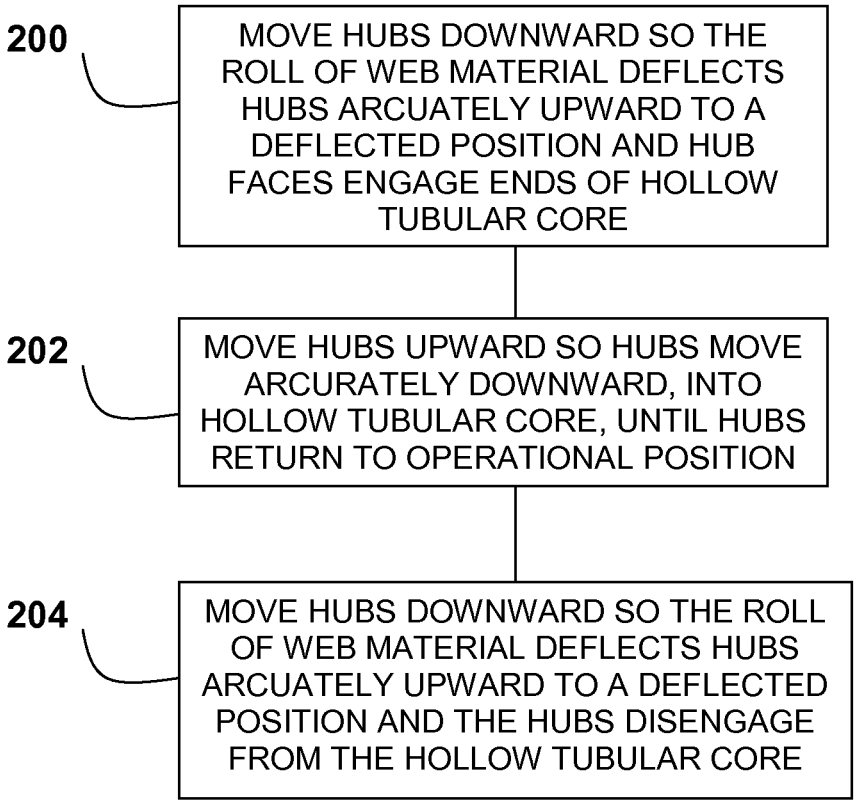
Figure 9:
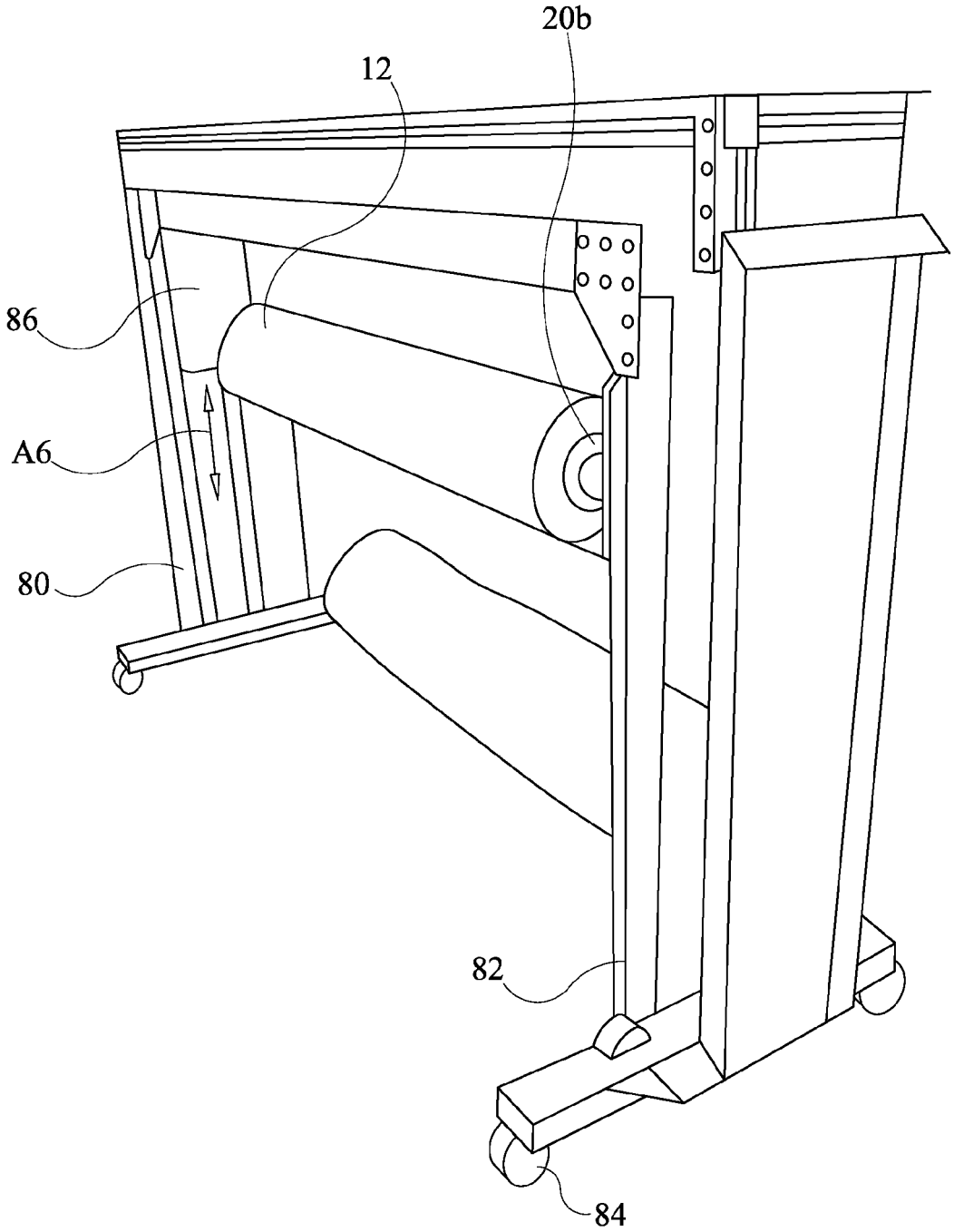
FIG. 9 illustrates an exemplary pick-up tool including the roll handling and loading system.

In an alternative environment of use, referring to FIG. 9, the pivot mechanism 46 and hubs 20*a*, 20*b* may be configured in a portable pick-up tool 80 that may be used for picking up a roll 12 of web material 13 by moving the hubs 20*a*, 20*b* down to the roll 12 of web material 13 instead of lifting the roll 12 of web material up to the hubs 20, 20*b*. The portable pick-up tool 80 comprises a frame 82 with casters 84 to provide portability, hubs 20*a*, 20*b* pivotably mounted on movable bars 86 in the frame 82, and a lift mechanism (not shown) for moving the movable bars 86 in a vertical direction of arrow A6 within the frame 82. Instead of the roll 12 of web material 13 being lifted upward toward the pivoting hubs 20*a*, 20*b*, a method of using the pick-up tool, shown in FIG. 7B, comprises a first step 200 of moving the movable bars 86 downward so that the pivoting hubs 20*a*, 20*b* in the portable pick-up tool 80 move downward toward the roll 12 of web material 13 and the hubs 20*a*, 20*b* pivot upward and engage the hollow tubular core 15 in the same fashion as described above. In step 202, the movable bars 86 may then be moved upward to permit the hubs 20*a*, 20*b* to move arcuately downward and into the hollow space 25 defined by the hollow tubular core 15 until the hubs 20*a*, 20*b* have returned to the operational position OP. The casters 84 in the frame 82 of the portable pick-up tool 80 may be used to transport the roll 12 of web material 13 to another location. In step 204, the roll 12 of web material 15 may be removed from the hubs 20*a*, 20*b* by moving hubs 20*a*, 20*b* downward to cause the hubs 20*a*, 20*b* to deflect upward to the deflected position DP and disengage from the hollow tubular core 15 and the caster 84 may be used to move the pick-up tool clear of the roll 12 of web material 13.

Many other modifications and variations may of course be devised given the above description of preferred embodiments for implementing the principles in the present disclosure. It is intended that all such modifications and variations be considered as within the spirit and scope of this disclosure, as defined in the following claims.

The invention claimed is:

1. A roll handling and loading system for a roll of web material comprising web material wound on a hollow tubular core, the roll of web material having a horizontally-oriented length, the system comprising:

a free-standing portable frame having casters for rolling movement of the portable frame and a horizontally-oriented space between opposing sides of the portable frame;

a pair of rotatable hubs positioned on the opposing sides of the portable frame and biased toward each other along a horizontal rotational axis, each of the hubs mounted on a movable bar for moving the movable bar and the hubs in a vertical direction relative to the portable frame, at least one of the hubs being adjustable along the horizontal rotational axis to accommodate a length of the roll, each of the hubs comprising a hub face having an annular shape, at least one of the hubs comprising a compression spring positioned within the at least one of the hubs along the horizontal rotational axis to provide an inward force toward the roll of web material, and each of the hubs pivotably supported on a pivot mechanism for pivoting movement between an operational position on the horizontal rotational axis and a deflected position in which the hub face of each of the hubs is deflected in an arcuate direction away from the horizontal rotational axis, the pivot mechanism having a hinge axis forming a pivot point positioned below the horizontal rotational axis of the pair of hubs.

2. The system of claim 1, wherein the pivot mechanism is adapted to deflect each of the hubs such that the deflected position is above the horizontal rotational axis.

3. The system of claim 2, wherein the pair of hubs is transitioned from the operational position to the deflected position by the roll of web material when the roll of web material is lifted from beneath the horizontal rotational axis of the pair of hubs into the horizontally-oriented space, and subsequent lowering of the roll of web material allows the pair of hubs to transition from the deflected position to the operational position and become seated in respective ends of the hollow tubular core of the roll of web material so as to bear the weight of the roll of web material.

4. The system of claim 2, wherein the pair of hubs is transitioned from the operational position to the deflected position by the roll of web material when the frame is positioned such that the roll of web material is within the horizontally-oriented space and the pair of hubs is lowered from a position above the roll of web material to a position where the hubs engage respective ends of the roll of web material, and subsequent raising of the pair of hubs allows the pair of hubs to transition from the deflected position to the operational position and become seated in respective ends of the hollow tubular core of the roll of web material.

5. The system of claim 1, wherein the hub face of each of the hubs has a cone or beveled shape.

6. The system of claim 5, wherein the cone or beveled shape of the hub face is inclined about 45 degrees with respect to the horizontal rotational axis.

7. The system of claim 1, wherein the pivot mechanism allows the hubs to transition from the deflected position to the operational position by a force of gravity.

8. A method of handling and loading a roll of web material comprising a web material wound on a hollow tubular core, the roll of web material having a horizontally-oriented length, the method comprising the steps of:

positioning a free-standing, portable frame having casters for rolling movement of the portable frame such that the roll of web material is within a horizontally-oriented space between opposing sides of the portable frame;

providing a pair of rotatable hubs relative to the portable frame, the pair of hubs positioned on opposing sides of the horizontally-oriented space between opposing sides of the portable frame and adapted to spin, adjusting at least one of the hubs along a horizontal rotational axis in the horizontally-oriented space to accommodate a length of the roll, lowering the pair of hubs from a position above the roll of web material to a position where the pair of hubs engages respective ends of the roll of web material so that each of the hubs is deflected arcuately upward by the roll of web material to a deflected position; and raising the pair of hubs relative to the portable frame to allow the hub face of each of the hubs to pivot downward and become seated in a respective end of the hollow tubular core of the roll of web material; and biasing the pair of hubs toward each other along a horizontal rotational axis of the roll of web material with a compression spring positioned in at least one of the hubs along the horizontal rotational axis to provide an inward force toward the roll of web material.

9. The method of claim 8, wherein the pair of hubs is raised to transition the pair of hubs from the deflected position to an operational position on a horizontal rotational axis of the pair of hubs.

10. The method of claim 9, further comprising transitioning the hubs from the deflected position to the operational position by a force of gravity.

11. The method of claim 8, further comprising lowering the pair of hubs relative to the portable frame so that each of the hubs is deflected arcuately upward by the roll of web material to the deflected position to allow the hub face of each of the hubs to be removed from the hollow tubular core of the roll of web material.

12. The system of claim 5, wherein the hub face has a cone shape with a smooth surface extending to a flattened distal end.

13. The system of claim 5, wherein the hub face has a cone shape with a smooth surface extending to a rounded distal end.

14. The system of claim 5, wherein the hub face has a beveled shape with a beveled surface extending to a flattened distal end.

* * * * *